US007662068B1

(12) United States Patent
Geller

(10) Patent No.: US 7,662,068 B1
(45) Date of Patent: Feb. 16, 2010

(54) TWO-PIECE FINGER WEIGHT DEVICE IV

(76) Inventor: Andrew S. Geller, 82 Rosehall Dr., P.O. Box 328, Lake Zurich, IL (US) 60047-0328

( * ) Notice: Subject to any disclaimer, the term of this patent is extended or adjusted under 35 U.S.C. 154(b) by 0 days.

(21) Appl. No.: 12/140,342

(22) Filed: Jun. 17, 2008

Related U.S. Application Data

(63) Continuation of application No. 11/427,252, filed on Jun. 28, 2006, now abandoned, which is a continuation-in-part of application No. 11/344,392, filed on Jan. 30, 2006, now abandoned, which is a continuation-in-part of application No. 11/154,028, filed on Jun. 16, 2005, now abandoned.

(51) Int. Cl.
*A63B 23/16* (2006.01)
*A63B 21/065* (2006.01)

(52) U.S. Cl. ..... 482/47; 482/44; 482/48; 482/105

(58) Field of Classification Search ..... 482/44, 482/47–50, 105; 128/880; 602/22; D10/3; 224/164
See application file for complete search history.

(56) References Cited

U.S. PATENT DOCUMENTS 2,359,148 A * 9/1944 Partridge ..... 224/164
3,588,105 A * 6/1971 Donohoe ..... 473/213
4,067,569 A * 1/1978 Palumbo ..... 482/48
4,258,914 A * 3/1981 Lalli ..... 482/55
4,632,389 A * 12/1986 Moss ..... 482/105
4,665,907 A * 5/1987 Leverette ..... 128/880
4,813,406 A * 3/1989 Ogle, II ..... 602/22
4,875,469 A * 10/1989 Brook et al. ..... 601/40
D349,864 S * 8/1994 Dunlap et al. ..... D11/3
6,112,373 A * 9/2000 Steinhauer et al. ..... 24/68 J
D433,470 S * 11/2000 Geller et al. ..... D21/683

* cited by examiner

*Primary Examiner*—Loan H Thanh
*Assistant Examiner*—Sandhara M Ganesan
(74) *Attorney, Agent, or Firm*—Jack Shore; Much Shelist

(57) ABSTRACT

A two piece finger weight device including a weight member and a strap for connecting the weight member to a finger. The device has an arcuate surface for receiving a strap defined by transversely spaced flanges at each end of the arcuate surface and outwardly extending flanges at the central portion of the arcuate section. The strap is secured to the weight member by interfitting openings in the strap with outwardly extending projections provided on the arcuate surface. The strap is further retained in position by a hinged member secured to one flange member, which hinged member is extended over the strap on the arcuate surface and secured to a projection located on the other flange.

10 Claims, 2 Drawing Sheets

TWO-PIECE FINGER WEIGHT DEVICE IV

This application is a continuation of U.S. patent Ser. No. 11/427,252 filed Jun. 28, 2006 entitled "Two-Piece Finger Weight Device III" which was a continuation-in-part of U.S. patent Ser. No. 11/344,392, filed Jan. 30, 2006 entitled "Two-Piece Finger Weight Device II" which was a continuation-in-part of U.S. patent Ser. No. 11/154,028 filed Jun. 16, 2005 entitled "Two-Piece Finger Weight Device."

BACKGROUND OF THE INVENTION

The present invention relates to a device that is weighted and securable to a finger to assist in strengthening the finger during use of the finger. Such a weight is invaluable for sports usage, piano playing and other activities where fingers are in constant use and thus, in need of strengthening.

DESCRIPTION OF THE PRIOR ART

There are a number of finger weight devices holding a plurality of weights on the market that have been used to strengthen fingers that are effective such as those cited in U.S. Pat. No. 757,041 to Hasfeld, U.S. Pat. No. 6,413,193 and in applicant's U.S. application entitled "Limb Weight Device" filed Nov. 29, 2004 and having Ser. No. 10/999,421. These devices while effective cannot be readily adjusted to be used on fingers of all sizes and when used are subject to becoming loose on a finger over time.

Similarly, while they can handle weights of varying sizes they make no provision for preventing expulsion of the weights when the finger goes through a strong forward motion such as throwing a baseball.

The simple and efficient design forming applicant's invention can be used on any size finger and the weights can quickly and easily be inserted. The finger weight assembly does not restrict circulation thus allowing the wearer to use for an extended time without discomfort.

SUMMARY OF THE INVENTION

In accordance with the present invention there is illustrated a two piece finger weight including a weight receiving portion designed to fit on the top of a finger. The weight receiving portion in the illustrated embodiment which is by way of example only defines 3 longitudinally extending cylindrical holes (in the direction of the finger) into which are fitted cylindrical rod segments. The holes can extend all the way through and in the illustrated embodiment they are blocked off at one end to prevent the weights from flying out when there is a sharp forward motion of the finger. Three are shown, but more or less can be provided as desired. The rod segments can be made of different materials depending on the finger weight desired. Examples of materials that can be used include tungsten and stainless steel.

To retain the weight holding device in position on a finger a separate strap is used. The weight holding device has a generally arcuate shape that has guide flanges at both ends to guide the strap about the arcuate surface. The strap portion defines spaced openings through which projections on the finger weight extend to secure the weight in position when the strap is guided around the arcuate surface and is tightened to the desired position around a finger. When tightened in position, the respective strap openings are placed in interengaging position with the upwardly extending projections on the weight holding member.

As previously stated, the strap receiving portion of the weight holding device has a generally arcuate shape recess that has two outwardly extending generally bulbous projections that engage the strap. The underside of the weight holding member is provided with a series of parallel transversely extending projections and the strap is provided with a series of bumps or projections that engage with the finger when secured thereto to prevent turning of the strap and finger weight relative to the finger.

Specifically, the upper center portion and the ends of the arcuate surface of the weight holding member includes side members or flanges that are spaced apart to define strap guides for the arcuate strap receiving portion of the weight member. Extending outwardly from one of the flange members at the upper center portion and hinged thereto is a member having an opening therein. The member is designed to extend over the upper portion of the arcuate weight strap receiving portion to retain the strap in place thereon.

The opening in the hinge member interfits with a projection extending upwardly from the flange member opposite thereto to lock the hinge member in position when disposed over the strap secured to the weight member.

The weight holding member can be made of a variety of materials an example of which is a relatively hard plastic of 85-90 durometer and a strap of approximately 73 durometer for flexibility. With the instant design, the weight holding member can be easily molded.

BRIEF DESCRIPTION OF THE DRAWINGS

To obtain a better understanding of the invention, reference is made to the accompanying drawings illustrating the invention in which.

DETAILED DESCRIPTION OF THE DRAWINGS

Figure 1:
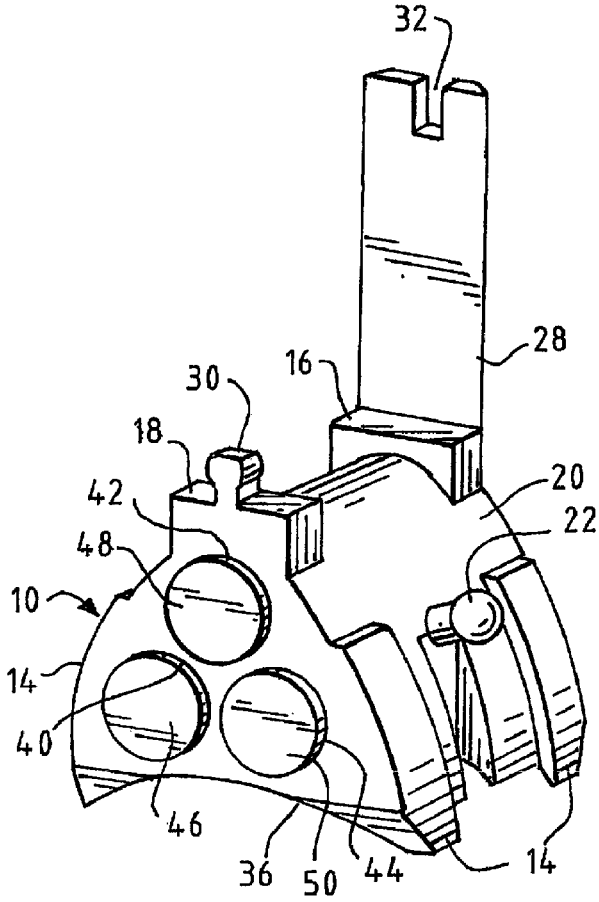
FIG. 1 is a perspective view of the novel finger weight member.
Figure 3:
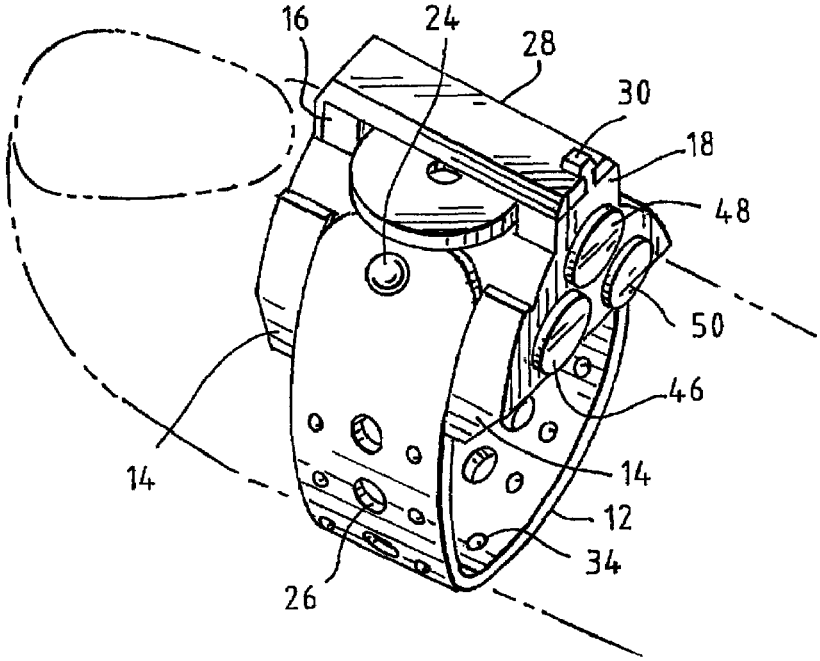
FIG. 3 is a perspective view of the finger weight device containing weights and the strap securing the weight device to a finger.

Referring to FIG. 1, there is illustrated the finger weight member 10 in the open position prior to receiving a strap 12 to secure it to a finger (see FIG. 3).

The weight member 10 has an outer surface of a roughly triangular configuration. This is defined by flange members 14, 16, and 18 and intermediate the flange members is an arcuate shaped strap receiving portion 20. The width of the arcuate section 20 and the adjacent flange members 14, 16, and 18 are constructed and arranged to guide the strap 12 as it is being wrapped around a finger. In accordance with the present invention, there are side flanges 14 located at each end of the arcuate section and outwardly extending flanges 16, 18 at the center portion of the arcuate section. The side flanges 14 located at the ends of the arcuate section have an outer surface that generally conforms to the arcuate section.

Located on opposite sides of the arcuate surface 20 are outwardly extending bulb-shaped projections 22, 24. The projections 22, 24 are sized to be received in openings 26 in the strap 12 after the strap has been tightly wrapped around a finger. Specifically the strap 12 when in the finger-wrapped position (see FIG. 3) has been guided around the finger and about the weight member 10 by the side flanges 14 and located and secured in placed by the interfitting projections 22, 24 and strap openings 26. While 2 are illustrated, the number of projections can be varied as desired along with the corresponding strap openings. What is illustrated is by way of example only.

Figure 4:
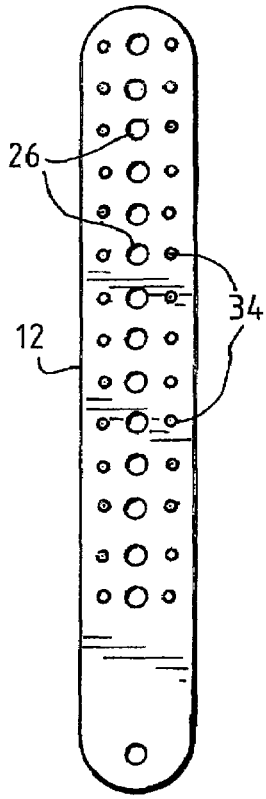
FIG. 4 is a view of the strap.

To retain the strap in position on the finger weight member, a member 28 is hinged to the outwardly extending flange 16. The size and shape of this member 28 is such that when it is hinged over the strap portion 12 located on the arcuate surface 20 as shown in FIG. 3, the strap is prevented from moving away from the arcuate support surface 20. To secure the member 28 in position the outwardly extending flange 18 is provided with an upstanding projection 30 that fits into the opening 32 formed in the hinged member 28. It is to be noted that the strap portion 12 has formed on its underside generally semi-spherical projections or bumps 34 in parallel relationship to, but on opposite sides of the strap openings 26 (see FIG. 4) to assist in preventing the strap 12 from turning relative to the weight member 10.

Figure 2:
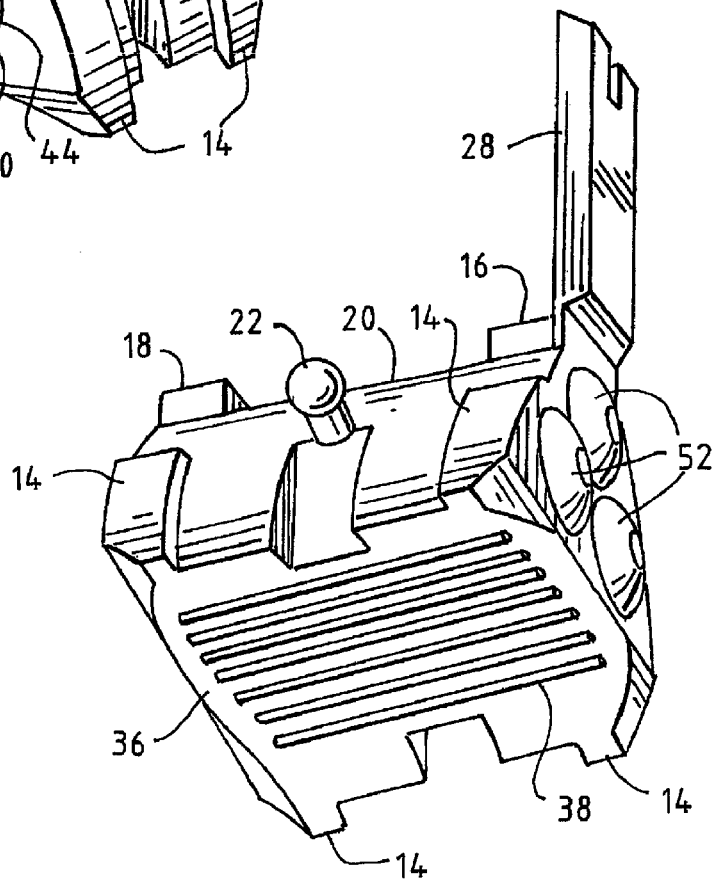
FIG. 2 is a perspective view of the finger weight device of FIG. 1 rotated to show the bottom of the finger weight member.

As shown in FIG. 2, the weight member 10 is curved on its underside 36 to generally conform to the finger on which it is to be placed. The curve is slightly flatter than a finger and thus, does not completely encompass the finger when the strap is tightened so as to not totally impede the circulation flow through the finger. There are transversely extending rib members 38 located on the underside of the weight member to limit the movement of the finger weight assembly relative to the finger.

The weight member 10 defines longitudinally extending (in the finger extending direction) cylindrical openings 40, 42, 44 for the receipt of cylindrical finger weights 46, 48, 50. The finger weights are in frictional engagement with the openings to retain them in position. In the illustrated embodiments, there are shown 3 openings, but this is by way of example only. There can be more or less as desired and can take different shapes. One or more weights can be inserted at any given time to vary the weight of the weight member as desired. Furthermore, the material of the weight can also be varied and two material examples that can be employed are stainless steel having an approximate weight of 10 grams/rod or tungsten having an approximate weight of 25 grams/rod.

The weight openings 40, 42, 44 shown in FIGS. 1, 2 and 3 do not extend all the way through in that the weight member 12 is formed with generally semi-spherical end covers 50.

It is intended to cover by the appended claims all embodiments that fall within the true spirit and scope of the invention.

The invention claimed is:

1. A finger weight device comprising a first member having at least one weight receiving portion, a strap for securing the member to a finger, the weight receiving member having an arcuate center section defined by two integrally formed transversely spaced outwardly extending flanges located at the ends of the arcuate section and at the upper portion of the arcuate section for guiding the strap around the arcuate section, the arcuate center section defining projections and the strap defining openings for receiving the projections extending from said center section and projections for preventing slippage of the strap and first member relative to the finger to which it is to be connected, extending outwardly from one of the flanges located at the upper portion of the arcuate center and integral therewith is a hinge member defining an opening and from the opposite transversely spaced flange extending outwardly from the upper portion of the center section is a connecting member which opening and connecting member are constructed and arranged to interfit to secure the hinge member to the other flange extending outwardly from the upper portion of the center section to retain the strap in place, whereby the user wraps the strap around their finger and on top of the arcuate section between the spaced flanges to secure the strap onto the projections of the arcuate center section and secures the hinge member on top of the strap to retain the finger weight device on a finger.

2. A finger weight device as set forth in claim 1 in which the flanges located at the ends of the arcuate section have an outer surface generally conforming to the arcuate center section.

3. A finger weight device as set forth in claim 1 which the connection to which the hinge member is connected is located on the opposite side of the hinge member.

4. A finger weight device as set forth in claim 1 in which the projections are bulb-shaped.

5. A finger weight device as set forth in claim 1 in which the bottom surface of the weight receiving member opposite the arcuate center section is arcuately shaped to generally conform to a finger.

6. A finger weight device as set forth in claim 5 in which there are provided transversely extending parallel projections extending outwardly from said bottom surface to help prevent the weight receiving member from moving relative to the finger when in engagement therewith.

7. A finger weight device as set forth in claim 1 in which the outer surface of said weight receiving member is generally triangular in configuration and defines openings for receiving weights therein.

8. A finger weight device as set forth in claim 7 in which the openings extend longitudinally and generally parallel to the finger on which it is to be located.

9. A finger weight as set forth in claim 8 in which the openings are closed at one end to prevent the weights from leaving the weight receiving member when the finger weight receiving device is suddenly moved in the direction of the closed end.

10. A finger weight device as set forth in claim 9 in which there are three longitudinally extending openings for receiving weights.

* * * * *

UNITED STATES PATENT AND TRADEMARK OFFICE

CERTIFICATE OF CORRECTION

PATENT NO. : 7,662,068 B1
APPLICATION NO. : 12/140342
DATED : February 16, 2010
INVENTOR(S) : Andrew S. Geller It is certified that error appears in the above-identified patent and that said Letters Patent is hereby corrected as shown below:

Title Page, Item (76) Inventor: "Andrew S. Geller, Lake Zurich, IL (US)"
Should read --(76) Inventors: Andrew S. Geller, Round Lake, IL (US); Burton I. Geller (deceased), Lake Zurich, IL (US); Alysmai Geller (legal representative), Lake Zurich, IL (US)--.

Signed and Sealed this
Thirteenth Day of September, 2011

David J. Kappos

David J. Kappos
*Director of the United States Patent and Trademark Office*